United States Patent [19]

Haendle

[11] Patent Number: 4,886,970

[45] Date of Patent: Dec. 12, 1989

[54] X-RAY DIAGNOSTIC DEVICE WITH AN X-RAY CONVERTER

[75] Inventor: Jörg Haendle, Erlangen, Fed. Rep. of Germany

[73] Assignee: Siemens Aktiengesellschaft, Berlin and Munich, Fed. Rep. of Germany

[21] Appl. No.: 647,962

[22] Filed: Sep. 6, 1984

[30] Foreign Application Priority Data

Sep. 9, 1983 [DE] Fed. Rep. of Germany ..... 33326487

[51] Int. Cl.[4] ..... H01J 31/50

[52] U.S. Cl. ..... 250/484.1; 250/327.2

[58] Field of Search ..... 250/327.2, 484.1, 486.1, 250/487.1, 213 R

[56] References Cited

U.S. PATENT DOCUMENTS 3,495,084 2/1970 Sheldon ..... 270/370 G X
3,859,527 1/1975 Luckey ..... 250/327
4,239,968 12/1980 Kotera et al. ..... 250/327.1
4,481,416 11/1984 Robatin ..... 250/327.2
4,508,966 4/1985 Oberschmid et al. ..... 250/484.1

FOREIGN PATENT DOCUMENTS 0022564 1/1981 European Pat. Off. .
2245696 9/1971 Fed. Rep. of Germany ..... 250/363

*Primary Examiner*—Janice A. Howell
*Assistant Examiner*—Richard Hanig
*Attorney, Agent, or Firm*—Mark H. Jay

[57] ABSTRACT

The invention relates to an X-ray diagnostic device with an X-ray converter having a luminescent fluoroscopic screen which latently stores the respective X-ray picture and can be activated to light up for image reproduction by an additional source of rays, with a scanning device for the fluoroscopic screen, an optical system, a detector, and a video monitor, in which an image intensifier is coupled to the luminescent fluoroscopic screen to form an image intensifier unit.

1 Claim, 1 Drawing Sheet

X-RAY DIAGNOSTIC DEVICE WITH AN X-RAY CONVERTER

BACKGROUND OF THE INVENTION

The invention relates to an X-ray diagnostic device with an X-ray converter with a luminescent fluoroscopic screen which latently stores the respective X-ray image and which can be activated to light up for image reproduction by an additional source of radiation, the device having a scanning device for the fluoroscopic screen, an optical system, a detector, and a video monitor. In X-ray diagnostics, such a fluoroscopic screen serves to record and reproduce an X-ray picture.

In German Offenlegungsschrift No. 29 28 244 is described such an X-ray diagnostic device in which an X-ray picture in a plate is first stored as a latent image, by means of a fluoroscopic screen of a luminescent substance which can be activated by visible light or infrared rays. The electron-hole pairs generated by the absorption of the X-rays in the film of luminescent material of the fluoroscopic screen are retained in a potential trap of the luminscent material so that the X-ray picture remains stored. The number of electron holes depends on the amount of absorbing radiation energy. It is only through scanning of the fluoroscopic screen picture element by picture element, as by an infrared laser beam, that these electron holes are raised to the conduction band, emitting visible light when they fall back to their original states. The stored X-ray image is made visible through activation with visible light or infrared rays, whereby the electrons stored in the potential trap of the luminescent substance are released, thus releasing the X-ray picture stored in the fluoroscopic screen in the form of fluoroscent light. The fluoroscent light is captured by a photodetector and converted into an electrical signal which is converted into a video image by a monitor.

This reference states that known fluoroscopic screens are of insufficient sensitivity. While the relative sensitivity can be improved by the selection of the luminescent material, it still is insufficient in many cases to produce X-ray pictures of adequate brightness because, for example, the optical coupling of the fluoroscopic screen to the detector results in further losses so that the noise component of the detector is not negligible.

The invention is directed to the problem of designing an X-ray diagnostic device of the kind mentioned so that the relative sensitivity is further improved and the output image of the fluoroscopic screen further intensified, so that the video pictures of high contrast and low noise component are obtained.

According to the invention, an image intensifier is electro-optically coupled to the luminescent fluoroscopic screen to form an image intensifier unit. It is through this coupled image intensifier that the picture, visible due to activating radiation, is further intensified so that losses such as are due to the optical coupling have no disturbing effect.

The dimensions can be kept relatively small if the image intensifier is a flat image intensifier with near field focussing. A particularly simple design results from the image intensifier unit having as an input screen a first carrier layer to which is applied an input fluoroscopic screen on which a photocathode is vapor-deposited, and there being applied to a second carrier layer, in the direction towards the input, an output fluoroscopic screen covered by a thin conducting film. The fluoroscopic screen can be scanned from the input side if the input fluoroscopic screen consists of thermo-luminescent material and the output fluoroscopic screen of zinc sulfide or cadmium sulfide, and if the first carrier layer is permeable to infrared radiation. One advantageous variant results from scanning taking place on the output side of the image intensifier unit; from the input fluoroscopic screen consisting of cesium iodide and the output fluoroscopic screen of thermoluminescence material; and from the second carrier layer being permeable for infrared radiation and visible light.

BRIEF DESCRIPTION OF THE DRAWINGS

Exemplary and non-limiting preferred embodiments of the invention are shown in the drawings, in which.

DETAILED DESCRIPTION OF PREFERRED EMBODIMENTS

Figure 1:
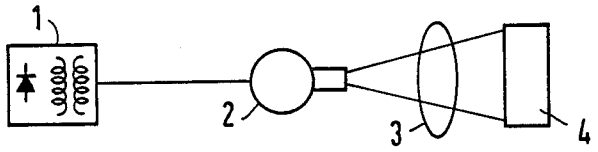
FIG. 1 depicts the recording section of an X-ray diagnostic device according to the invention.
Figure 2:
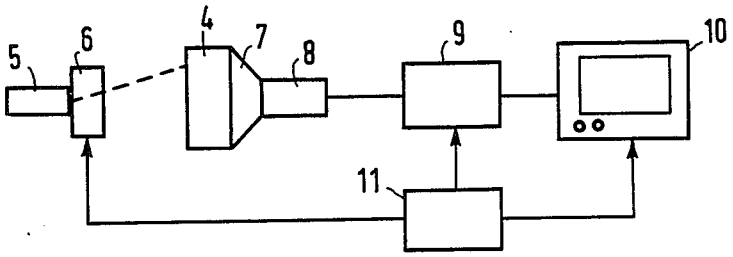
FIG. 2 shows the reproduction section of an X-ray diagnostic device according to the invention.

FIG. 1 shows a high voltage supply 1 which feeds an X-ray tube 2 which emits X-ray penetrating a patient 3. The X-rays, attenuated according to the patient's transparency, strike an image intensifier unit 4, which contains a fluoroscopic screen of luminescent material and a coupled flat image intensifier with near field focussing. This incident X-ray image produces in the fluoroscopic screen of the image intensifier unit 4 electron holes which are stored in a potential trap of the luminescent material so that a latent image is stored in the fluoroscopic screen of the image intensifier unit 4.

For the reproduction of the latent image the fluoroscopic screen of the image intensifier unit 4 is scanned image element by image element as by a laser beam generated by a laser 5, and deflected over the fluoroscopic screen surface of the image intensifier unit 4 by a deflecting device 6. The deflecting device 6 for the laser 5 may consist, for example, of a deflecting mirror for the vertical deflection and an electro-optical beam deflector for the horizontal deflection. As a result of the scanning of the laser beam, all of the image elements on the fluoroscopic screen are activated successively and caused to light up. An optical system 7 projects the image displayed on the output fluoroscopic screen of the image intensifier unit 4 onto a detector 8 which picks up the brightness of the scanned image elements and feeds the information to a reproducing circuit 9 which generates from the individual analog output signals of the detector 8 a video signal for display on a monitor 10. The reproducing circuit 9 may contain, e.g., image storage facilities, processing circuits and converters. A control unit 11 produces control clocking signals to synchronize the deflecting device 6, the reproducing circuit 9, and the monitor 10.

Figure 3:
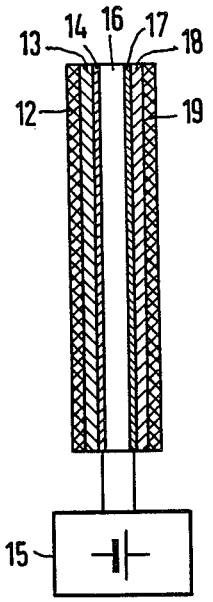
FIG. 3 is a schematic illustration of the arrangement of layers in the image intensifier unit shown in FIGS. 1 and 2.

The operation of the image intensifier unit 4 will now be explained in detail by way of FIG. 3. The image intensifier unit 4 has first carrier layer 12 on the input side facing the X-ray tube 2. The first carrier layer 12 is secured to the input side of the input fluoroscopic screen 13. A photocathode 14, connected to one terminal of a voltage source 15, is vapor-deposited on the other side of the input fluoroscopic screen 13. The first carrier layer 12, the input fluoroscopic screen 13, and the photocathode form an input screen assembly. After the input screen is a vacuum gap 16 which may be e.g. 12 mm thick and which serves as an acceleration region. The output screen assembly of the image intensifier unit 4, adjacent to the input screen assembly and facing the detector 8, consists of a second carrier layer 19 to which is secured on the input side an output fluoroscopic screen 18. For delineation of the vacuum gap 16 there is applied to the inner (input) side of output fluoroscopic screen 18 a thin conducting film 17 to which the other terminal of the voltage source 15 is connected.

In use, X-ray radiation causes electron-hole pairs to be produced and stored in the screen 13. Upon scanning, these pairs recombine. This recombination produces light which in turn produces electrons upon striking the photocathode 14.

In this example, the image intensifier unit 4 has two preferred embodiments. In the first, the input fluoroscopic screen 18 of zinc sulfide or cadmium sulfide. The carrier layers 12 and 19 may be glass, the carrier layer 12 being permeable to infrared radiation if scanning is carried out by an infrared laser. The photocathode 14 may consist e.g. of an antimony-cesium compound and the film 17 may be of aluminum. When the X-ray image is reproduced on the input fluoroscopic screen 13, electron holes are produced in accordance with the energy of the individual image elements and stored in the potential traps of the luminescent material. If subsequently the input fluoroscopic screen 13 is scanned image element by image element from the input side by an infrared laser beam generated by the laser 5, the electron holes are released and accelerated by the acceleration voltage of e.g. more than 5 kV applied between the photocathode 14 and the thin film 17, to strike the output fluoroscopic screen 18. Thus an image with intensified brightness (factor 50 to 100) is transmitted on the output fluoroscopic screen 18. Through the final glass carrier 19 the light generated in the output fluoroscopic screen 18 is projected on the photodetector 8 by the optical system 7.

In a second preferred embodiment of the image intensifier unit 4 the input fluoroscopic screen 13 consists of cesium iodide and the output fluoroscopic screen 18 of thermo-luminescent material. The first carrier layer 12 may be aluminum, as is common practice in image intensifier technology, while the second carrier layer 19 must be permeable for infrared and visible light rays. In this case, the second carrier layer 19 may also consist of infrared-permeable glass. Due to the impinging X-rays photoelectrons are generated in the input fluoroscopic screen 13 and accelerated in the vacuum gap 16, striking the output fluoroscopic screen 18 and producing electron holes. The electron holes are then trapped in potential traps in the output fluoroscopic screen 18 once again. Subsequently they can be scanned from the output side as by an infrared laser beam, so that again a visible image originates image element by image element for reproduction on the detector 8. Additive screen interference structures can be suppressed better by this activation of the output fluoroscopic screen 18, but the saturation limit of the luminescent material must not be exceeded.

In this example, even at low image doses the detector 8 is still driven sufficiently so that the noise level of the signal from the detector 8 is negligible.

Those skilled in the art will understand that changes can be made in the preferred embodiments here described, and that these embodiments can be used for other purposes. Such changes and uses are within the scope of the invention, which is limited only by the claims which follow.

What is claimed is:

1. An X-ray diagnostic device of a type in which a luminescent fluoroscopic screen stores a latent X-ray image, the screen is scanned with radiation from a radiation source that is directed by a deflecting device to produce an optical image, and the optical image is passed through an optical system and made incident upon a detector for display on a video monitor, comprising:

a flat image intensifier with near filed focussing which is electro-optically coupled to the luminescent fluoroscopic screen to form an image intensifier unit, said unit comprising an inut screen assembly comprising a first carrier layer, an input fluoroscopic screen and a photocathode, the input fluoroscopic screen being of X-ray luminescent material and being secured on one surface to the carrier layer, and the photocathode being vapor-deposited on another surface of the input fluoroscopic screen; and an output screen assembly comprising a second carrier layer which is permeable to infrared and visible radiation, an output fluoroscopic screen and a thin conducting film, the output fluoroscopic screen being of thermo-luminescent material and being secured on one surface to the second carrier layer, and the thin conducting film being secured to another surface of the output fluoroscopic screen to face the input screen assembly.

* * * * *